US005492517A

United States Patent [19]

Bostic et al.

[11] Patent Number: 5,492,517

[45] Date of Patent: Feb. 20, 1996

[54] EXERCISE DEVICE

[75] Inventors: James R. Bostic, Watertown; Alan E. Doop, Delano; Michael E. Heutmaker, Long Lake, all of Minn.

[73] Assignee: NordicTrack, Inc., Chaska, Minn.

[21] Appl. No.: 330,110

[22] Filed: Oct. 27, 1994

Related U.S. Application Data

[63] Continuation of Ser. No. 73,202, Jun. 7, 1993, abandoned, which is a continuation-in-part of Ser. No. 913,680, Jul. 14, 1992, abandoned, which is a continuation-in-part of Ser. No. 877,524, May 1, 1992, Pat. No. 5,226,866.

[51] Int. Cl.[6] ..... A63B 22/02

[52] U.S. Cl. ..... 482/70; 482/54; 482/110

[58] Field of Search ..... 482/51, 52, 53, 482/54, 64, 70, 71, 110, 115, 116, 118, 702

[56] References Cited

U.S. PATENT DOCUMENTS

| | | | |
|---|---|---|---|
| 921,755 | 5/1909 | Volk . | |
| 1,766,089 | 6/1930 | Wood . | |
| 3,332,683 | 7/1967 | Rand | 273/55 |
| 3,554,541 | 1/1971 | Seaman | 272/69 |
| 3,637,206 | 1/1972 | Chickering, III | 272/69 |
| 3,711,090 | 1/1973 | Fiedler | 272/69 |
| 4,066,257 | 1/1978 | Moller | 272/69 |
| 4,151,988 | 5/1979 | Nabinger | 272/69 |
| 4,544,152 | 10/1985 | Taitel | 272/69 |
| 4,614,336 | 9/1986 | Taitel | 272/69 |
| 4,659,074 | 4/1987 | Taitel et al. | 272/69 |

*Primary Examiner*—Stephen R. Crow
*Attorney, Agent, or Firm*—Merchant & Gould

[57] ABSTRACT

Disclosed herein is a device that facilitates contemporaneous exercise of the upper and lower body. The exercise device includes a treadmill rotatably mounted relative to a frame and a pair of arm poles pivotally mounted relative to the frame. Resistance to operation of the treadmill is provided by a flywheel that rotates subject to frictional resistance provided by a drag strap in contact with the flywheel. A shaft cooperates with the flywheel to maintain tension in the drag strap, and the tension may be adjusted by rotating the shaft about its longitudinal axis. Resistance to operation of the arm poles is provided by friction pads disposed between the arm poles and structure associated with the frame.

26 Claims, 9 Drawing Sheets

EXERCISE DEVICE

This is a continuation of application Ser. No. 08/073,202 filed Jun. 7, 1993, now abandoned, which is a continuation in part of U.S. patent application Ser. No. 07/913,680 filed Jul. 14, 1992 (now abandoned), which is a continuation-in-part of U.S. patent application Ser. No. 07/877,524 filed May 1, 1992 (now U.S. Pat. No. 5,226,866).

FIELD OF THE INVENTION

The present invention relates to an exercise apparatus including structure for exercising the legs as well as structure for exercising the arms. Resistance structure is provided to create resistance to movement of the leg exercising structure. Further, resistance structure is provided to provide resistance to movement of the arm exercising structure.

It is desirable in exercising to incorporate both upper body and lower body movement. The combination of upper and lower body exercise is advantageous to create an aerobic workout. Further, using a variety of muscles increases the degree of toning provided by the exercise.

Thus, it is desirable to use exercise apparatus which are constructed and arranged to exercise both the upper and the lower body.

One such device is the exercise machine described in U.S. Pat. No. 4,618,139, issued Oct. 21, 1986, to Gary Haaheim. This device includes wheeled trucks on which the feet move forward and backward, and arm poles 17 which pivot forward and rearward.

Another such device is that shown in U.S. Pat. No. 5, 207,622, issued May 4, 1993 to William Wilkinson. This device includes a treadmill-like surface for exercising the lower body, and arm poles for exercising the upper body.

The present invention provides the ability to provide identical resistance to movement of each of the arm poles simultaneously, and to vary that resistance as desired.

SUMMARY OF THE INVENTION

The present invention relates to an exercise apparatus having a support frame to which is mounted a treadmill surface and a pair of arm-actuated poles. Resistance structure is provided to create resistance to movement of the treadmill surface. Second resistance structure is provided to provide selected resistance to pivotal movement of both arm poles simultaneously.

BRIEF DESCRIPTION OF THE DRAWINGS

Throughout the views, in which like elements are numbered identically.

DETAILED DESCRIPTION OF THE PREFERRED EMBODIMENT(S)

Figure 1:
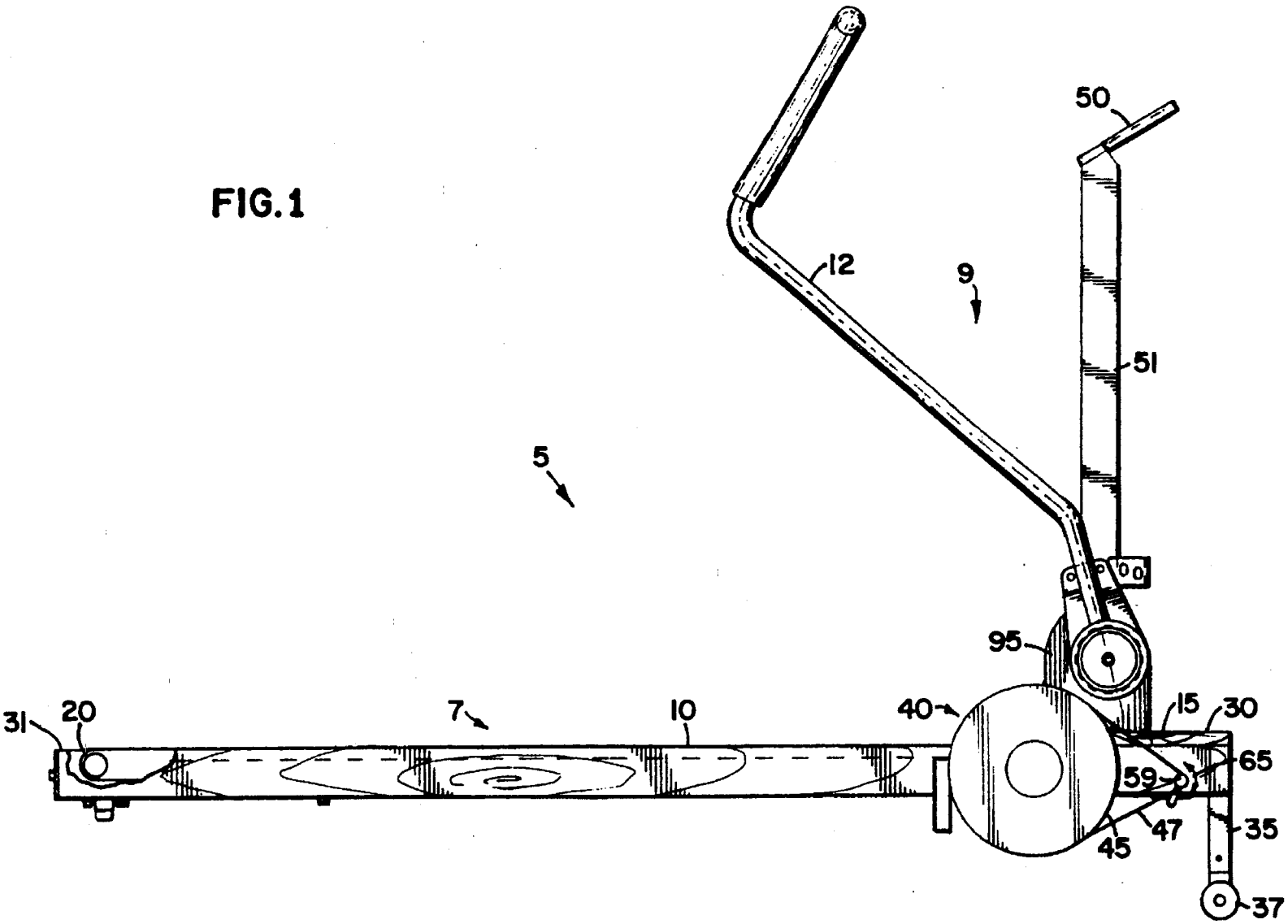
FIG. 1 is a side elevational view of an exercise apparatus according to the present invention.

In FIG. 1, an exercise apparatus 5 is shown which includes structure 7 for exercising one's legs, and further includes structure 9 for exercising one's arms and upper body. More specifically, the preferred embodiment of exercise apparatus 5, illustrated in FIG. 1, includes a treadmill surface 10 and a pair of arm actuated poles **12*a* and 12*b*. The treadmill surface 10 and the arm poles 12 are mounted to a frame structure 15. The treadmill surface 10 is continuous and is mounted within the frame structure 15 in a conventional manner. In the embodiment illustrated, the treadmill surface 10 loops around a rear idler roller and front a drive roller 19 and 25 respectfully. The rear idler roller 19 transverses the width of the frame 15 and is constructed and arranged to rotate about its longitudinal axis. Front drive roller 25 is constructed and arranged to transverse the width of the frame 15** and to rotate about its longitudinal axis.

The frame structure 15 has a front portion 30 and a rear portion 31. A pair of collapsible legs 35 engage the ground and support the upper or front portion of the frame 30. Wheels 37 can be provided at the ground engaging end of legs 35 for convenient transportation of the exercise apparatus 5.

The resistance of the treadmill surface to movement, is supplied by resistance structure 40. More specifically, resistance structure 40 includes a flywheel 45 having a circumferential contact surface 46 about which a resistance or drag strap 47 passes. A buckle 48 cooperates with the drag strap 47 to form a continuous belt. By adjusting the tension on the resistance strap 47, the amount of resistance to movement of the flywheel is adjusted. The flywheel 45 is connected to the axis of the front drive roller, so that the resistance structure 40 provides resistance to movement of the front drive roller 25 and accordingly, resistance to movement of the treadmill surface 10.

The flywheel 45 incorporates a one-way clutch which allows free movement of the flywheel in one direction, but precludes movement in the opposite direction. In the embodiment illustrated, the flywheel is allowed to turn freely in the backward direction, or counter-clockwise direction, but is precluded from moving in the forward or clockwise direction. U.S. Pat. No. 4,023,795, issued May 17, 1977, to Edward A. Pauls is incorporated herein by reference, and further describes the use of a flywheel with a resistance strap or band and a one-way clutch in an exercise device.

Figure 14:
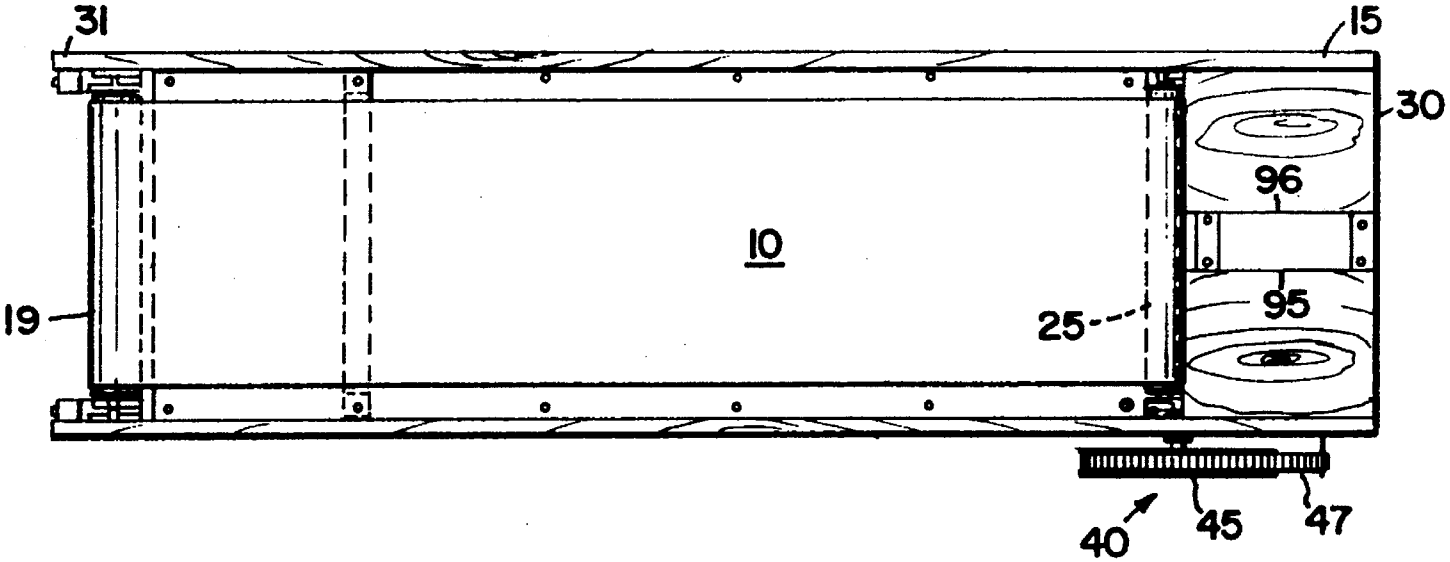
FIG. 14 is a top view of the exercise apparatus illustrated in FIG. 1, with portions of the exercise apparatus eliminated for clarity.
Figure 15:
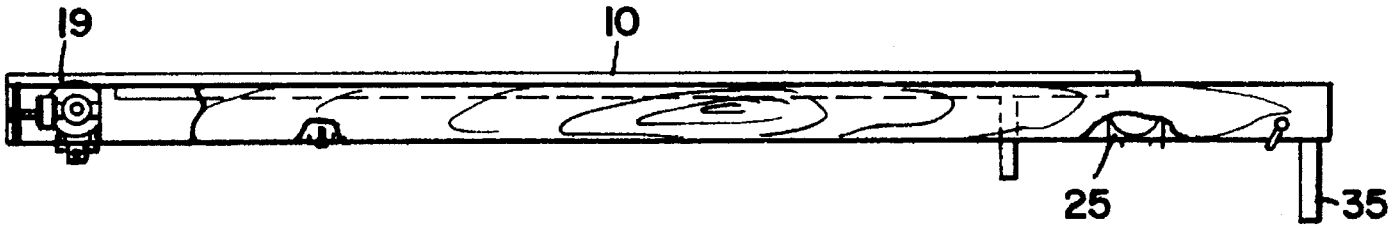
FIG. 15 is a side view of a portion of the exercise apparatus illustrated in FIG. 1, with portions cut out, and portions eliminated for clarity.

FIGS. 14 and 15 further illustrate the features discussed above. FIG. 17 includes cut-away portions to show the rear idler roller 19 and the front drive roller 25.

Returning to FIG. 1, the preferred embodiment of the exercise apparatus 5 includes a display panel 50, which is supported by a member 51 which is attached to frame 15. The display panel 50 is connected electronically to the structure 7 for exercising the legs to keep track of and provide a display of distance walked, velocity, and other desirable exercise parameters.

Figure 2:
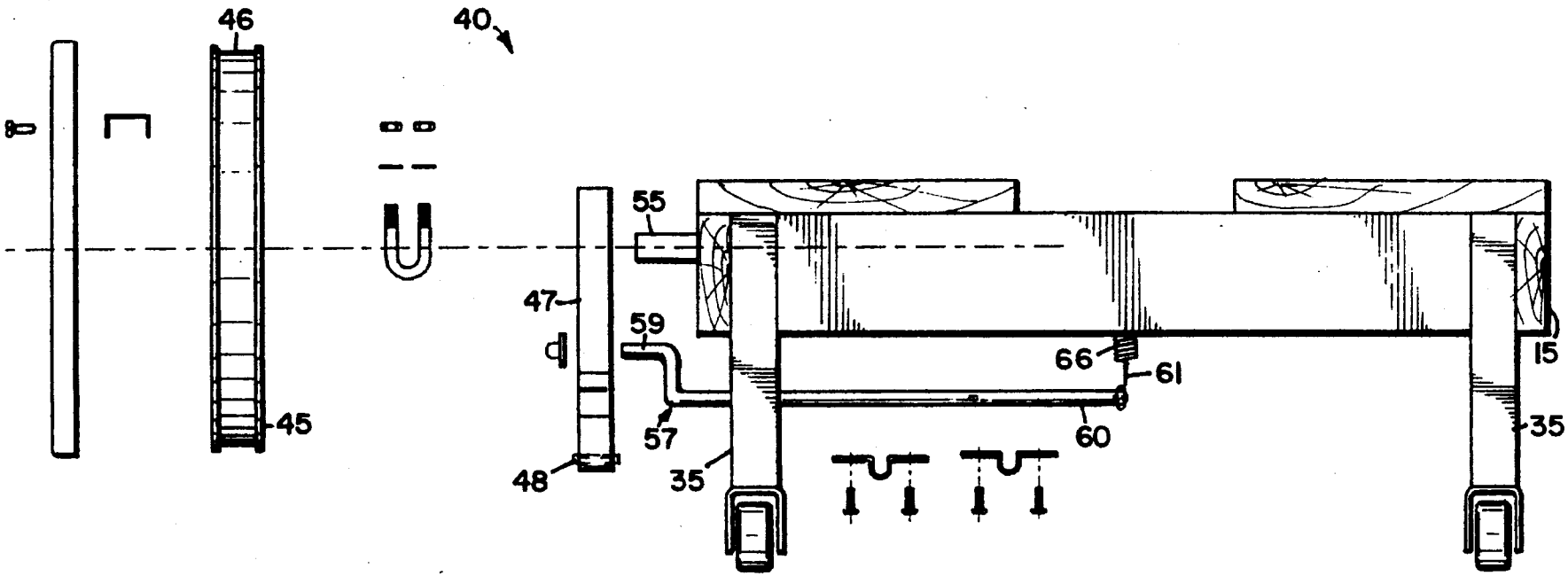
FIG. 2 is an enlarged exploded assembly view, taken from the front, of the exercise apparatus illustrated in FIG. 1.

Returning to FIG. 2, the resistance structure 40 is shown in greater detail in an assembly view from the front of the exercise apparatus. The flywheel 45 is attached to an axis 55 which in turn is attached to the front drive roller 25. A linkage 57 is provided to modify the resistance on the strap 47. An end 59 of tensioning lever or linkage bar 60 passes through and engages resistance strap 47. This is illustrated in FIG. 1 as well. End 59 of linkage bar 60 travels along an arcuate path indicated by arrow 65 in FIG. 1. This is accomplished, for example, by applying force to the opposite end 61 of linkage bar 60 to cause rotational movement of linkage bar 60. In the embodiment illustrated, end 61 is attached to a spring member 66 which in turn is connected by a cable 56 to a resistance selection knob 53 which the user turns to achieve the desired resistance. Each of ends [60] and 59 and 61 are spaced from the axis of linkage bar 60 about which linkage bar 59 rotates. Thus, arcuate movement of end 61 causes arcuate movement of end 59. A cap or cover 70 covers the flywheel.

In use, the user walks or runs on the treadmill surface, causing front drive roller 25 to turn. The ability of drive roller 25 to turn or rotate is inhibited by the resistance of the flywheel to turning as a result of the friction created by the resistance strap. Thus, by adjusting the tension on the resistance strap, the resistance of the treadmill surface to movement is correspondingly adjusted.

Figure 3:
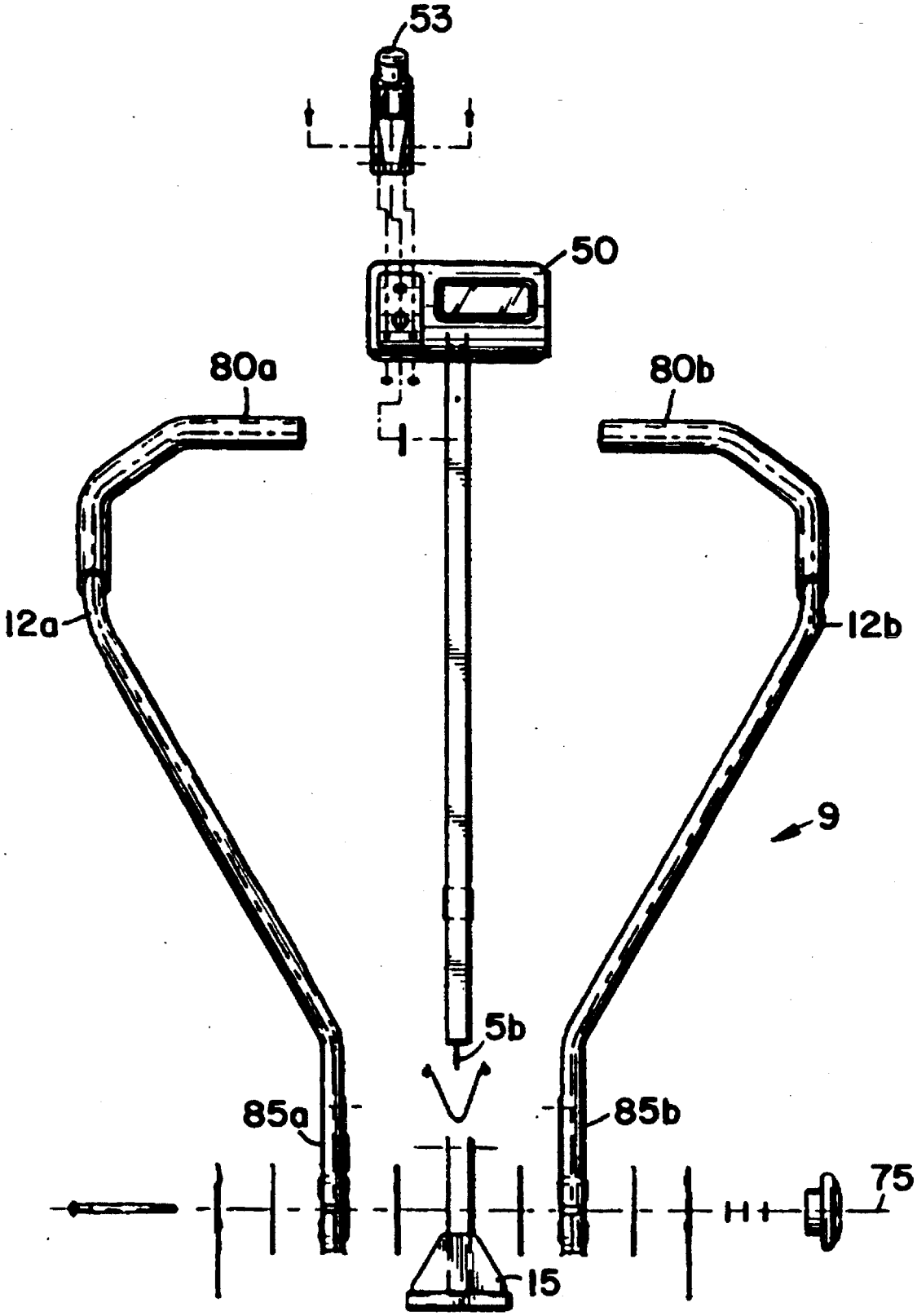
FIG. 3 is an exploded assembly view, taken from the front of portions of the exercise apparatus illustrated in FIG. 1.

Turning to FIG. 3, an assembly view of the arm exercise structure 9 is illustrated. The arm exercise structure 9 includes two arm poles 12*a* and 12*b* which are connected to the frame structure 15 such that each arm pole can pivot individually about an axis 75.

Figure 4:
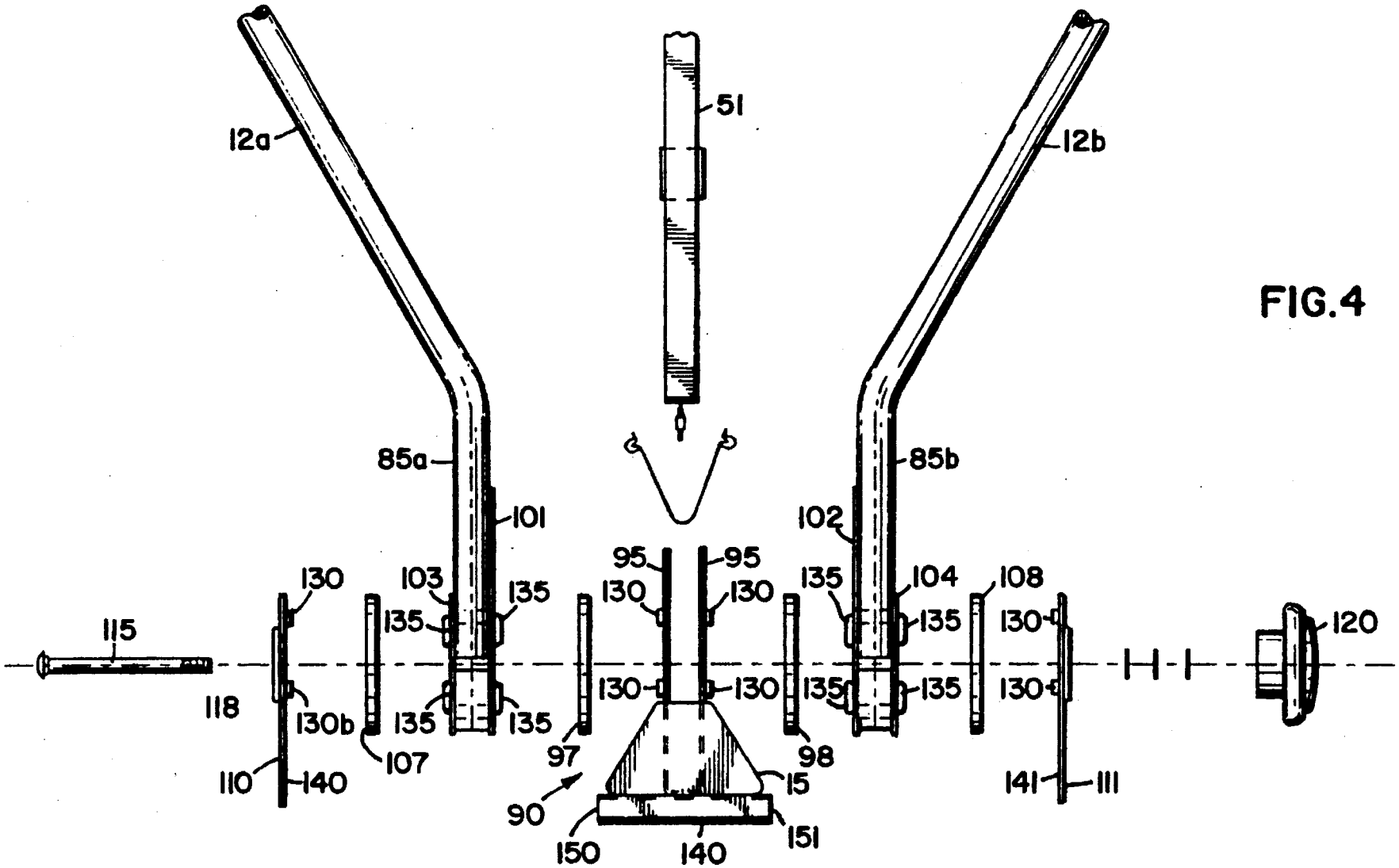
FIG. 4 is an enlarged exploded view of a portion of the exercise apparatus illustrated in FIG. 1.

Arm poles 12*a* and 12*b* are generally mirror images of one another. The arm poles 12*a* and 12*b* include first and second ends 80*a* and 80*b* constructed and arranged to be gripped by the user. Arm poles 12*a* and 12*b* are sized and shaped to be gripped comfortably by a user standing on the treadmill surface 10. Ends 80*a* and 80*b* are spaced apart a comfortable distance for hand placement. The opposite ends 85*a* and 85*b* of arm poles 12*a* and 12*b* are both pivotally connected to the central portion of frame 15. Turning to FIG. 4, the structure for pivotally attaching the arm poles 12*a* and 12*b* to the frame structure is illustrated in greater detail.

Generally, inner support structure 90 is attached to frame structure 15. In the preferred embodiment illustrated, inner support structure 90 includes two generally parallel plate members 95 and 96. These will be identified as inner support plates. Located between inner support plate 95 and arm pole 12*a* is a brake pad 97. Between inner support plate 96 and brake pole 12*b* is brake pad 98. For convenient reference, "inner" refers to the center of the width of the exercise apparatus 5, and "outer" refers to the edges of the width of the frame.

Plates are provided on opposite sides of each pole. Specifically, an inner pole plate 101 is provided on pole 12*a* and an inner pole plate 102 is provided on pole 12*b*. An outer pole plate 103 is provided on pole 12*a* and an outer pole plate 104 is provided on pole 12*b* . Generally, brake pad 97 is located and squeezed between inner pole plate 101 and inner support plate 95. Similarly, brake pad 98 is located and squeezed between inner support plate 96 and inner pole plate 102. A second set of brake pads is provided on the outer side of the poles 12*a* and 12*b*. More specifically, an outer brake pad 107 abuts outer pole plate 103, and outer brake pad 108 abuts outer pole plate 104. Outer support plates 110 and 111 are provided to abut the outer faces of outer brake pads 107 and 108. Thus, when assembled, brake pad 107 is squeezed between outer support plate 110 and outer pole plate 103, and outer brake pad 108 is squeezed between outer support plate 111 and outer pole plate 104.

The outer support plates 110 and 111, the outer brake pads 107 and 108, pole plates 103,101, 102 and 104, and brake pads 97 and 98 are all preferably mounted on one axis 115, which in the preferred embodiment is a bolt threaded at one end 118 to be received by a tapped knob 120. When turned, knob 120 increases or decreases the compression of brake pads 97, 98, 107 and 108.

Figure 6:
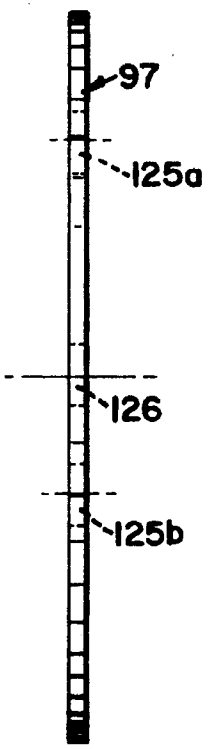
FIGS. 5 and 6 are front and side views of a brake pad incorporated into the exercise apparatus illustrated in FIG. 1.
Figure 5:
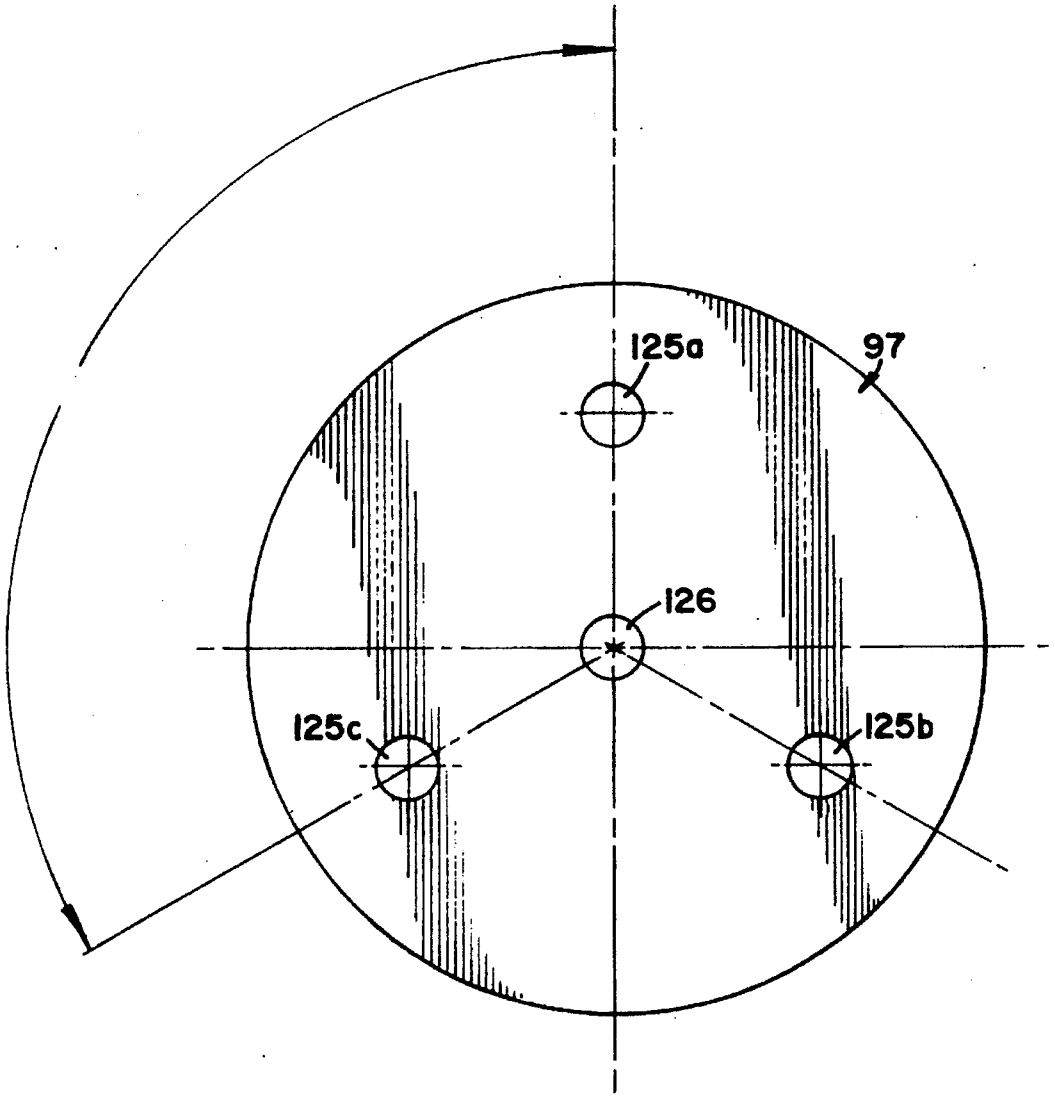
Figure 8:
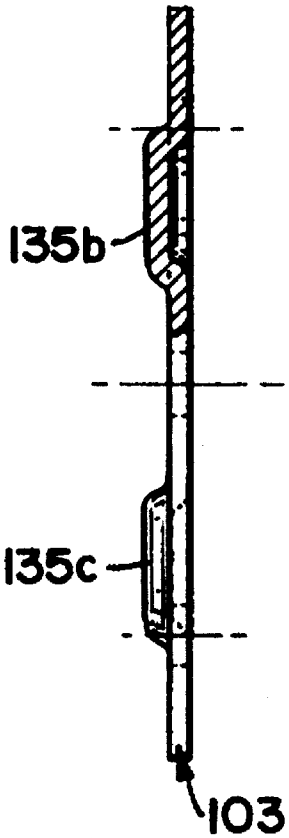
FIG. 8 is a side, cross-sectional view of the brake pad illustrated in FIG. 7.
Figure 7:
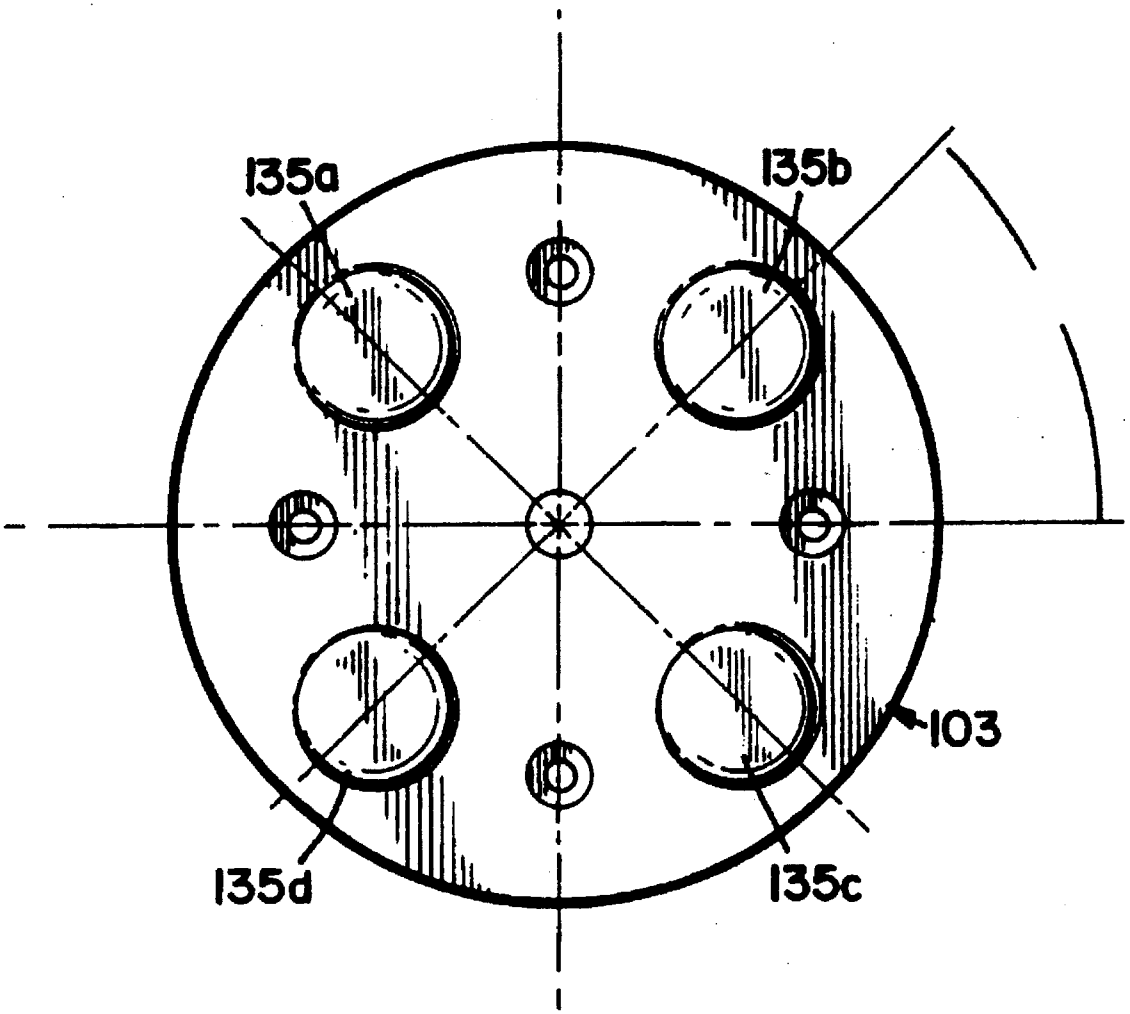
FIG. 7 is an enlarged elevated view of a plate incorporated into the exercise apparatus illustrated in FIG. 1.
Figure 11:
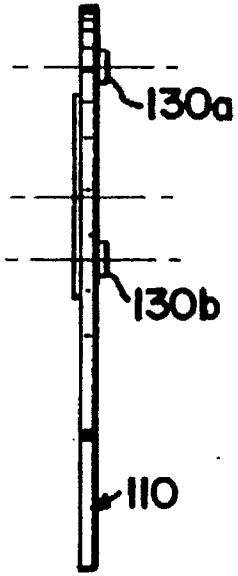
FIG. 11 is a side elevational view of the plate illustrated in FIG. 9.

In the preferred embodiment, each of the brake pads 97, 98, 107 and 108 include three through-holes 125. Brake pad 97 is illustrated in FIG. 5 and 6, and a center hole 126. Brake pads 98, 107, and 108 are substantially similar to the brake pad 98 illustrated in FIGS. 5 and 6.

In the preferred illustrated embodiment, through-holes 125*a*, 125*b* and 125*c* are generally spaced at 120 degree intervals. Support plates 110, 95, 96, and 111 each include protrusions 130*a*, 130*b* and 130*c* which engage through-holes 125*a*, 125*b*, and 125*c* of an adjacent brake pad, such that the brake pads are effectively anchored to one abutting plate, and turn with respect to the other abutting plate. More specifically, brake pad 107 is anchored to outer support plate 110, and rotates with respect to pole plate 103 when pole 12*a* is rotated about axis 115. Brake pad 97 is anchored to inner support plate 95, and rotates with respect to pole plate 101 when pole 12*a* is rotated about axis 115. Brake pad 98 is anchored to inner support plate 96, and rotates with respect to pole plate 102 when pole 12*b* is rotated about axis 115. Brake pad 108 is anchored to outer support plate 111, and rotates with respect to pole plate 104 when pole 12*b* is rotated about axis 115.

Figure 10:
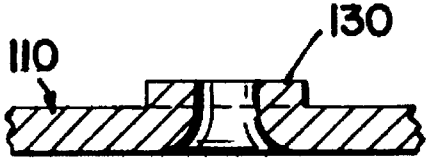
FIG. 10 is an enlarged, cross-sectional view of a portion of the plate illustrated in FIG. 9.
Figure 9:
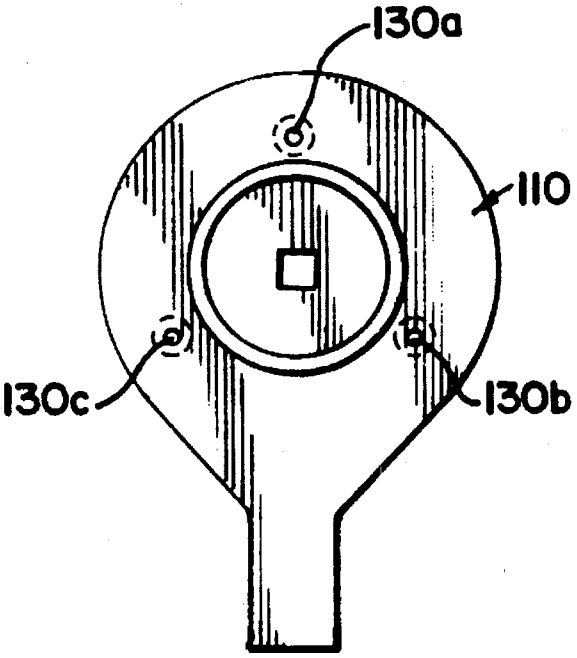
FIG. 9 is an enlarged elevational view of a plate incorporated into the exercise apparatus of FIG. 1.

FIGS. 9 through 10 illustrate outer support plate 110. Protrusions 130*a*, 130*b* and 130*c* are illustrated. FIG. 10 illustrates in greater detail a protrusion 130 in the surface of plate 110. Similar protrusions, located and arranged to match the holes 125 in the brake pads, are provided on inner support plates 5 and 96 and outer support plates 111.

To enhance the smoothness of the pivoting motion of arm poles 12*a* and 12*b* about axis 115, it has been found that having raised portions on plates 103, 101, 102, and 104 is preferable over a simple planar surface. It has been found that planar surfaces cause some sticking in the movement of the arm poles. FIGS. and 8 illustrate raised portions 135*a*, 135*b*, 135*c*, and 135*d*. These are also visible in FIG. 4. Four raised portions are illustrated, though it should be understood that other numbers of raised portions may achieve the desirable result of smooth movement of the arm poles. The raised portions 135 on plates 103,101, 102 and 104 are generally square-shaped with rounded corners in the embodiment illustrated.

Plates 103, 101, 102 and 104 are preferably fastened directly to poles 12*a* and 12*b*. Plates 110 and 111 each a include leg portion 140 and 141, respectfully, which is received in a slot 150 or 151, respectfully, in the bracket 140 which mounts to the frame structure 15.

Figure 13:
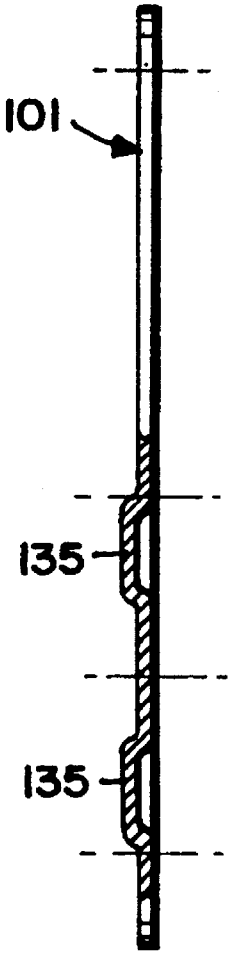
FIG. 13 is a side, view of the plate illustrated in FIG. 12.
Figure 12:
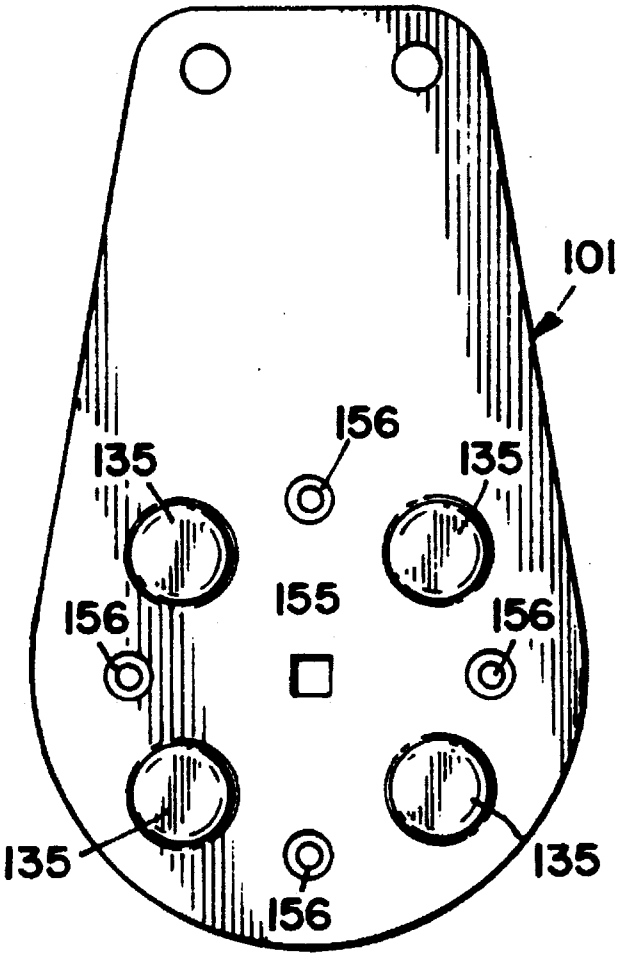
FIG. 12 is an elevational, enlarged view of a plate incorporated into the exercise apparatus illustrated in FIG. 1.

FIGS. 12 and 13 show inner pole plate 101, which is substantially identical to inner pole plate 102. As noted above, inner pole plate 101 includes protrusions 135 which provide smooth surfaces which abut brake pad 97. A central aperture 155 is provided through which axis 115 passes. The other apertures illustrated 156 are used for attaching plate 101 to pole 12*a*.

It will be understood with respect to FIG. 4, that when knob 120 is rotated about axis 115, the resistance structure is squeezed together generally in a linear direction. This squeezes the brake pads and increases the friction between the brake pads 107, 97, 98 and 108 and respective abutting plates 103,101, 102 and 104. In this manner, the resistance against pivotal movement of the arm poles 12*a* and 12*b*. Further, each of arm poles 12*a* and 12*b* is exposed to the same resistance to pivotal movement.

It can be seen from FIG. 1 that inner support plate 95 extends generally upwardly from frame structure 15. It can further be seen in FIG. 16, that inner support plates 95 and 96 are generally centrally located across the width of frame structure 15.

Although the present invention has been described with reference to preferred embodiments, workers skilled in the art will recognize that changes may be made in form and detail without departing from the spirit and scope of the invention.

What is claimed is:

1. An exercise resistance device, comprising:

a flywheel;

a drag strap disposed about a portion of a cylindrical contact surface on said flywheel;

a shaft having a longitudinal axis;

a first radially displaced member on said shaft, wherein said first radially displaced member is operatively connected to said drag strap at a radial distance from said shaft, and movement of said first radially displaced member relative to said flywheel alters tension in said drag strap;

a second radially displaced member on said shaft;

an adjusting means operatively connected to said second radially displaced member at a radial distance from said shaft, for adjusting tension in said drag strap, wherein operation of said adjusting means causes movement of said first radially displaced member relative to said flywheel.

2. An exercise resistance device according to claim 1, wherein said shaft, said first radially displaced member, and said second radially displaced member are integrally joined to one another.

3. An exercise resistance device according to claim 1, wherein said flywheel rotates about a flywheel axis that is substantially parallel to said longitudinal axis.

4. An exercise resistance device according to claim 1, wherein said drag strap includes an intermediate portion disposed about said portion of said cylindrical contact surface, and said first radially displaced member is operatively connected to portions of said drag strap on opposite sides of said intermediate portion.

5. An exercise resistance device according to claim 1, wherein operation of said adjusting means causes orbital movement of said second radially displaced member about said longitudinal axis, which in turn, causes orbital movement of said first radially displaced member about said longitudinal axis.

6. An exercise resistance device according to claim 1, wherein said adjusting means includes a knob, and rotation of said knob in a first direction causes orbital movement of said first radially displaced member in a first direction, and rotation of said knob in a second, opposite direction causes orbital movement of said first radially displaced member in a second, opposite direction.

7. An exercise resistance device according to claim 6, wherein said adjusting means further includes a cable that extends between and interconnects said knob and said second radially displaced member, and rotation of said knob alters tension in said cable, which in turn, causes orbital movement of said second radially displaced member and said first radially displaced member about said longitudinal axis.

8. An exercise apparatus, comprising:

a frame having a right side and a left side and a frame width defined therebetween;

a tread having a right side and a left side and a tread width defined therebetween, wherein said tread is rotatably mounted relative to said frame;

a flywheel rotatably mounted relative to said frame and operatively connected to said tread, wherein rotation of said tread causes rotation of said flywheel;

a drag strap disposed about a portion of a cylindrical contact surface on said flywheel;

a shaft extending from within said frame width to beyond said tread width;

a first radially displaced member connected to said shaft beyond said frame width and connected at a radial distance from said shaft to said drag strap, wherein orbital movement of said first radially displaced member alters tension in said drag strap; and a second radially displaced member connected to said shaft within said frame width and connected at a radial distance from said shaft to an actuator that causes orbital movement of said second radially displaced member, which in turn, causes orbital movement of said first radially displaced member.

9. An exercise apparatus according to claim 8, wherein said flywheel is rotatably mounted to one of said right side and said left side of said frame and outside said tread width.

10. An exercise apparatus according to claim 8, further comprising a roller rotatably mounted to said frame and disposed within and supporting said tread, wherein said flywheel shares a common axis of rotation with said roller.

11. An exercise apparatus according to claim 10, wherein said shaft rotates about a longitudinal axis that extends substantially parallel to said common axis.

12. An exercise apparatus according to claim 8, wherein said first radially displaced member is integrally joined to said shaft, and said second radially displaced member is integrally joined to said shaft.

13. An exercise apparatus according to claim 8, wherein said drag strap includes an intermediate portion disposed about said portion of said cylindrical contact surface, and said first radially displaced member is operatively connected to portions of said drag strap on opposite sides of said intermediate portion.

14. An exercise apparatus according to claim 8, wherein said drag strap is formed into a continuous belt, and at least a portion of said first radially displaced member is disposed within said continuous belt.

15. An exercise apparatus according to claim 8, further comprising a post extending upward from said frame, wherein said actuator is mounted on said post and connected to said second radially displaced member by means of a cable.

16. An exercise apparatus according to claim 15, wherein said actuator includes a knob connected to said cable, and rotation of said knob relative to said post alters tension in said cable, which in turn, causes orbital movement of said second radially displaced member and said first radially displaced member.

17. An exercise apparatus according to claim 15, further comprising:

a right arm actuated pole pivotally mounted relative to said frame proximate said post;

a left arm actuated pole pivotally mounted relative to said frame proximate said post; and a resistance mechanism connected to said right arm actuated pole and said left arm actuated pole.

18. An exercise apparatus, comprising:

a frame having a right side and a left side and a frame width defined therebetween;

a tread formed into a continuous loop and rotatably mounted relative to said frame inside said frame width;

a flywheel rotatably mounted relative to said frame outside said frame width, wherein said flywheel is operatively connected to said tread so that rotation of said tread causes rotation of said flywheel;

a drag strap formed into a continuous belt and disposed about a portion of a cylindrical contact surface on said flywheel;

a shaft having a longitudinal axis and extending along said longitudinal axis from inside said frame width to outside said frame width and into engagement with said continuous belt, wherein said shaft and said flywheel cooperate to maintain tension in said continuous belt; and an actuator mounted relative to said frame and operatively connected to said shaft, wherein operation of said actuator causes said shaft to move relative to said flywheel and thereby alters tension in said continuous belt.

19. An exercise apparatus according to claim 18, wherein operation of said actuator causes said shaft to rotate about its longitudinal axis and thereby alters tension in said continuous belt.

20. An exercise apparatus according to claim 18, wherein a radially offset portion of said shaft is disposed within and engages said continuous belt, and said shaft is rotatably mounted relative to said frame, and rotation of said shaft about said longitudinal axis causes orbital movement of said radially offset portion about said longitudinal axis and thereby alters tension in said continuous belt.

21. An exercise apparatus according to claim 18, further comprising a roller disposed within said continuous loop and supporting said tread in such a manner that said roller rotates together with said tread relative to said frame, wherein said roller and said flywheel share a common axis of rotation.

22. An exercise apparatus according to claim 18, wherein said shaft extends to a position within said continuous belt.

23. An exercise apparatus according to claim 18, wherein only said flywheel and said shaft engage said drag strap.

24. An exercise apparatus according to claim 18, wherein said actuator includes a knob and a cable that interconnects said knob and said shaft, and rotation of said knob causes rotation of said shaft about said longitudinal axis, which in turn, alters tension in said continuous belt.

25. An exercise apparatus according to claim 24, wherein said shaft includes a first radially offset portion connected to said cable, and a second radially offset portion connected to said continuous belt.

26. An exercise apparatus according to claim 18, further comprising a buckle on said drag strap that connects portions of said drag strap on opposite sides of said portion of said cylindrical contact surface and thereby forms said continuous belt, wherein said buckle is adjustable relative to said drag strap to define a variable effective length of said continuous belt.

* * * * *